United States Patent [19]

Vöhringer et al.

[11] Patent Number: 4,798,340

[45] Date of Patent: Jan. 17, 1989

[54] ELECTROSTATIC DEVICE FOR POWDER SPRAYING WITH TRIBOELECTRIC POWDER CHARGING

[75] Inventors: Gerhard F. Vöhringer, Markdorf; Kurt Pfeifer, Salem-Beuren, both of Fed. Rep. of Germany

[73] Assignee: ESB Elektrostatische Spruh- und Beschichtungsanlagen G.F. Vohringer GmbH, Meersburg, Fed. Rep. of Germany

[21] Appl. No.: 112,840

[22] PCT Filed: Jan. 9, 1987

[86] PCT No.: PCT/DE87/00004

§ 371 Date: Sep. 11, 1987

§ 102(e) Date: Sep. 11, 1987

[87] PCT Pub. No.: WO87/04088

PCT Pub. Date: Jul. 16, 1987

[30] Foreign Application Priority Data

Jan. 14, 1986 [DE] Fed. Rep. of Germany ..... 3600808

[51] Int. Cl.[4] ..... B05B 5/02

[52] U.S. Cl. ..... 239/692; 239/698; 239/705; 239/706; 239/590.5

[58] Field of Search ..... 239/3, 690, 690.1, 692, 239/696, 697, 698, 704–708, 590, 590.5

[56] References Cited

U.S. PATENT DOCUMENTS

| | | | |
|---|---|---|---|
| 3,667,675 | 6/1972 | Sherman et al. | 239/698 |
| 3,819,115 | 6/1974 | Soderman | 239/698 |
| 3,903,321 | 9/1975 | Schaad | 239/698 X |
| 4,090,666 | 5/1978 | Peck | 239/692 |
| 4,135,667 | 1/1979 | Beredek et al. | 239/697 |
| 4,225,090 | 9/1980 | Kako et al. | 239/692 |
| 4,359,192 | 11/1982 | Takahashi et al. | 239/692 |
| 4,659,019 | 4/1987 | Talacko | 239/692 |

FOREIGN PATENT DOCUMENTS

| | | | |
|---|---|---|---|
| 6933925 | 8/1969 | Fed. Rep. of Germany . | |
| 2203351 | 8/1973 | Fed. Rep. of Germany . | |
| 2642587 | 4/1977 | Fed. Rep. of Germany . | |
| 2555547 | 6/1977 | Fed. Rep. of Germany . | |
| 2646798 | 4/1978 | Fed. Rep. of Germany . | |
| 2938806 | 4/1980 | Fed. Rep. of Germany . | |
| 8432887 | 2/1985 | Fed. Rep. of Germany . | |
| 3402945 | 8/1985 | Fed. Rep. of Germany . | |
| 3430275 | 2/1986 | Fed. Rep. of Germany | 239/692 |
| 3529703 | 8/1986 | Fed. Rep. of Germany | 239/704 |
| 3600808 | 7/1987 | Fed. Rep. of Germany . | |
| 2583310 | 12/1986 | France | 239/692 |
| 134841 | 3/1979 | German Democratic Rep. | 239/704 |

*Primary Examiner*—Andres Kashnikow
*Assistant Examiner*—Mary Beth O. Jones
*Attorney, Agent, or Firm*—Herbert Dubno

[57] ABSTRACT

A stream of carrier gas with powder particles is introduced at the feeding end (2) of a powder pipe (1) in the direction of arrow (3) for coating workpieces. The material of the coating powder, of the powder pipe (1) and of displacement bodies (21, 22) built in the latter have different dielectric constants. At a certain distance from the outlet end (5) is mounted a charging device (12) provided with boosting electrodes (15) projecting inwardly and connected through a protective resistance (15) to a high-voltage supply (17). A rear counter-electrode (7, 26, 27) comprises an earthed conductive body (7). The displacement bodies (21, 22) accelerate the flow of powder particles. The latter come repeatedly in contact with the inner surface (11) of the powder pipe (1) and the displacement bodies (21, 22) communicating negatively charged particles (10) to them, after charge separation, whereas the positively charged particles (4) remain attached to the powder particles. The concentration of negatively (10) and positively (4) charged particles at opposite ends (2, 5) of the pipe is increased through the electrostatic field acting between the boosting electrodes (13) and the counter-electrode (7, 26, 27). The coating powder is thus so highly charged that an outer electrostatic field between a spraying electrode and the workpiece can be dispensed with.

24 Claims, 2 Drawing Sheets

ELECTROSTATIC DEVICE FOR POWDER SPRAYING WITH TRIBOELECTRIC POWDER CHARGING

BACKGROUND OF THE INVENTION

Field of the Invention

The invention relates to an electrostatic powder-spraying device with triboelectric powder charging by means of a powder pipe surrounding a delivery channel for the spray powder and of at least one displacement body located in the flow channel in order to boost the flow velocity, whereby the powder pipe is grounded on the outside and provided at least on its inside with a triboelectric material, which is arranged in the elctrostatic contact series at a distance from the material of the powder particles to be sprayed.

A comparable device for powder spraying is known from the German published specification No. 29 38 806. Therein the charging of the powder is done in a pipe-shaped nozzle element, whose flow channel is narrowed by a guide body, in order to increase the velocity and to produce a vortex. In addition, the outside of the nozzle is grounded or connected to high tension. Thereby the particles with opposite charges can be separated at a contact with the walling of the nozzle which is coated with a triboelectric material or displacement body. Reportedly the charging of the particles is improved through this device.

However, a separate electric field has to be introduced between the nozzle and the work piece to guide the charged particles towards the material. Since the electrostatic field varies with the points, edges and other protrusions of the workpiece, neutral zones are created on the workpiece. The coating powder can by this apparatus only to an insufficient extent reach the edges and crevices in the workpiece. As a result, the coating is uneven, which is the basic cause of early surface damage such as rust spots or the like, to the coated workpiece.

The invention departs from the electrostatic device for powder spraying as described above and aims towards the object of building such a device in the simplest manner. Deposition of the coating powder should be uniformly even in the case of workpieces with complicated configurations and the efficiency of this deposition should be increased.

SUMMARY OF THE INVENTION

In order to solve this problem according to the invention an additional charging device for the triboelectrically charged powder particles is used, with the same polarity as the one induced during the electrostatic charging.

This way, the charge of the powder particles can be increased so much that these particles can find their way to the workpiece, without introducing an electrostatic field between the spraying device and the workpiece and, to a large extent, without depending on other guiding forces, such as gas pressure-flow forces and the like. Due to this, the powder particles can reach into complicated recesses in the workpiece, the coating is improved over the entire surface, and protection is increased against damage or destruction from the outside.

It is therefore essential that the electrostatic charging through the selection of the appropriate triboelectric material and of the spraying powder, as well as through the guiding of the powder flow to the fixed walling of the device be performed as intensively as possible, respectively with the required flow velocity and to see to it that the charge which is created on the device side is lead away.

The aftercharging has to be performed primarily through an electrode supplied by an electric high-voltage power line, as radially inwardly extending wire electrodes. However, it can also be appropriate to perform a further aftercharging immediately before the exit of the powder from the nozzle, which under certain circumstances can again be performed triboelectrically.

Particular importance is attached to the configuration and arrangement of multiply provided displacement bodies, which can be located in the flow channel, but also in a preceding transport channel, and finally shortly before the nozzle exit.

BRIEF DESCRIPTION OF THE DRAWING

Further features and advantages of the invention are described in more detail through the following description of embodiment examples of the invention. There are shown.

DETAILED DESCRIPTION

Figure 1:
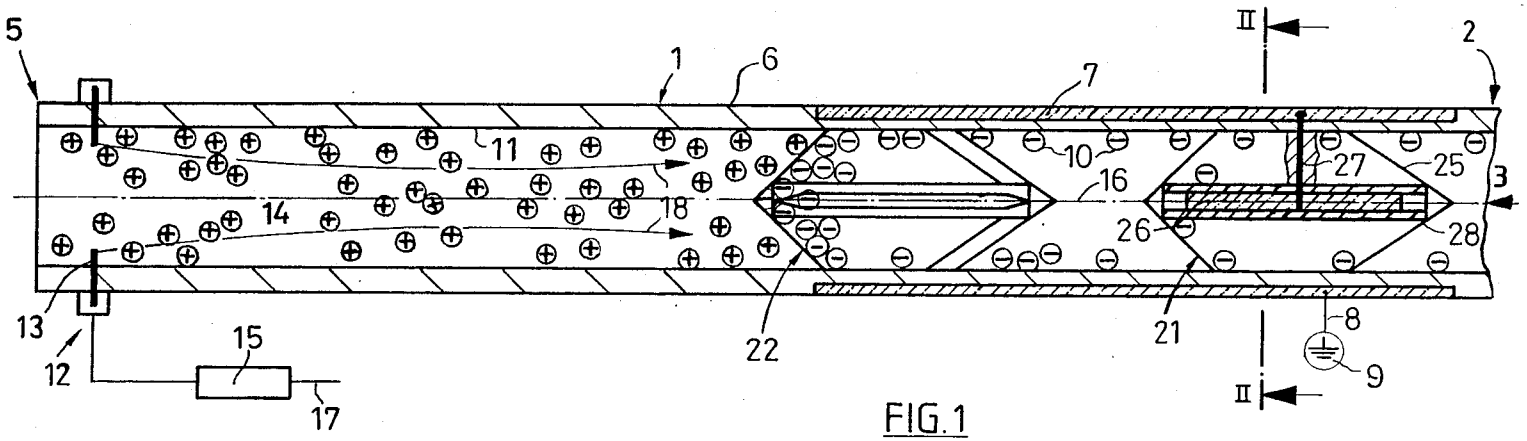
FIG. 1 a partial longitudinal section through an otherwise schematically represented electrostatic device for powder spraying according to the invention, FIG. 2 a cross section along the line II—II in FIG. 1, FIG. 3 a partially sectioned sideview of a gun for powder spraying built according to the invention, FIG. 4 a first modified version of this gun, partially in longitudinal section and FIG. 5 a further development of the embodiment in FIG. 4.
Figure 2:
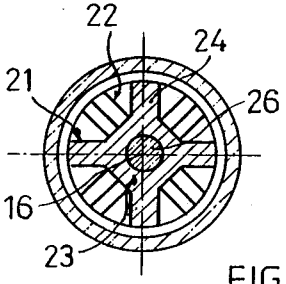

The carrying part of the device shown in FIGS. 1 and 2 is a powder pipe (1) towards which a stream of carrier gas is directed from the feeding end (2) following arrow (3) with a plurality of powder particles evenly distributed in this stream of carrier gas, which according to FIG. 1 are shown as positive charges (4) and which leave the powder pipe (1) at its outlet end (5) in order to be guided particularly through electrostatic charging forces to a workpiece, which is connected to the ground potential.

A grounded conductive body (7) formed as part of a counter-electrode is imbedded in the outer surface (6) of the powder pipe and has the shape of a cylindrical bushing which is flush with outer surface (6) of the powder pipe. This conductive body (7) is connected via a conduit (8) with a ground connection (9).

While the conductive body (7) is made suitably of a conductive material, such as copper or brass, the powder pipe (1) consists suitably of an insulator, particularly an insulating synthetic material. Polytetrafluoro ethylene (TFE) is preferred. A special advantage of this material is the big difference between its dielectric constant and that of the commonly used coating powders, especially epoxy resins. During their travel through the flow channel (14) formed by the powder pipe (1), the individual particles come in contact several times with the inner surface (11) of the pipe, whereby in the initally neutral particles a separation according to charge occurs. Negatively charged particles (10) get attached to the inside of the powder pipe (1), while the positively charged particles (4) continue to travel with the powder particles.

In order to increase the positive charge of the powder particles, an additional charging device (12) is provided here closely to the outlet end (5). Device (12) can, for instance, have two boosting electrodes (13) consisting, for instance, of two wire electrodes which extend approximately radially into the delivery channel defined by the inner surface (11) and are connected through a highly-resistive protective resistance (15) to a high-voltage supply (17).

The electrostatical charge is boosted by two displacement bodies (21) and (22) which like the powder pipe (1) are made of PTFE and rest with a slight pressure against the inner surface (11) of the powder pipe.

Both displacement bodies have each a core (23) with a square cross section, bearing on the outside guide ribs (24) arranged crosswise and dividing the circumference into equal segments, which run parallelly to the pipe axis (16) and towards the ends of the displacement bodies and are provided with wedge-like inclines (25). The margins (28) of the guide ribs (24) can also be sharpened on the side facing the oncoming flow (arrow 3) to have a cutting shape.

Both displacement bodies (21, 22) are rotated by 45° with respect to each other, in accordance with the representation in FIG. 2. Each of the displacement bodies reduces the free flow cross section in the flow channel (14) by less than the half of the available cross section surface. In addition, the powder particles can not flow through linearly, but are deflected circumferentially. A vortex is thereby created bringing about additional contacts with the surfaces defining the displacement bodies and the powder pipe (1). This takes place at an approximately doubled velocity considerably increasing the effect of electrostatic charging.

In order to keep the charging effect at the defining surfaces of the displacement bodies approximately at the same level with the one occuring at the inner surface (11) of the powder pipe, a cylindrical metallic rod (26) is located in an axial hollow of the core (23) of the displacement body (21). Rod (26) is connected with the respective displacement body, the powder pipe (1) and its grounded conductive body (7) via pin (27) running through radially. Pin (27) serves thereby as a grounding as well as a position securing means for the displacement body. The pin further serves as a counter-electrode which includes the grounded conductive body (7) and the metal rod (26).

In operation the coating powder, distributed as evenly as possible through its carrier gas, is blown in the direction of arrow (3) from the feeding end (2) into the powder pipe (1). Due to the contacts with the inner surface (11) and the displacement bodies (21) and (22), more and more charged particles, after going through a separation process, yield their negative charged particles (10) to the powder pipe (1) and the metallic body (26). As a result, the powder is charged positively in a tribolelectric manner.

This charge is boosted towards the outlet end (5) by the aftercharger (12). An electrostatic field is thereby generated between the aftercharger electrode (13) and the counter-electrode formed by the parts (7, 26, 27). An electrostatic field is generated corresponding to the indicated field lines (18) which effectuates a charging balance with the negatively charged particles (10).

At the same time the electrostatic field brings the already positively charged particles (4) to a higher charging potential. The tendency of the positively charged particles (4) to balance the negatively charged particles (10) results in the entire electrostatic field moving into the flow channel (10). Thereby is prevented both the exit of the electrostatic field through the nozzle opening and the resulting formation of electrically neutral zones (faraday screens) at the workpiece. Due to the improved charging of the coating powder, larger amounts of powder can be passed through the device. Since the artificially high-voltage field extends far into the inner space (14) of the powder pipe (1) in a direction opposite to the oncoming powder flow, the heretofore used external high-voltage field between the electrodes and the sprayed workpiece can be avoided. Since no neutral zones can appear at the workpiece, a complete coating can also be achieved in the areas of deepset corners and inner edges.

The voltage of the high-voltage supply (17) can be adjusted to the individual working conditions correspondingly, for instance to the materials used for the powder pipe (1), or the coating powder and also to the type and number of inserted displacement bodies. It is also possible to adjust voltage automatically to operational data, such as the distance to the workpiece, the percentage of the deposited powder, and also the current intensity.

Figure 3:
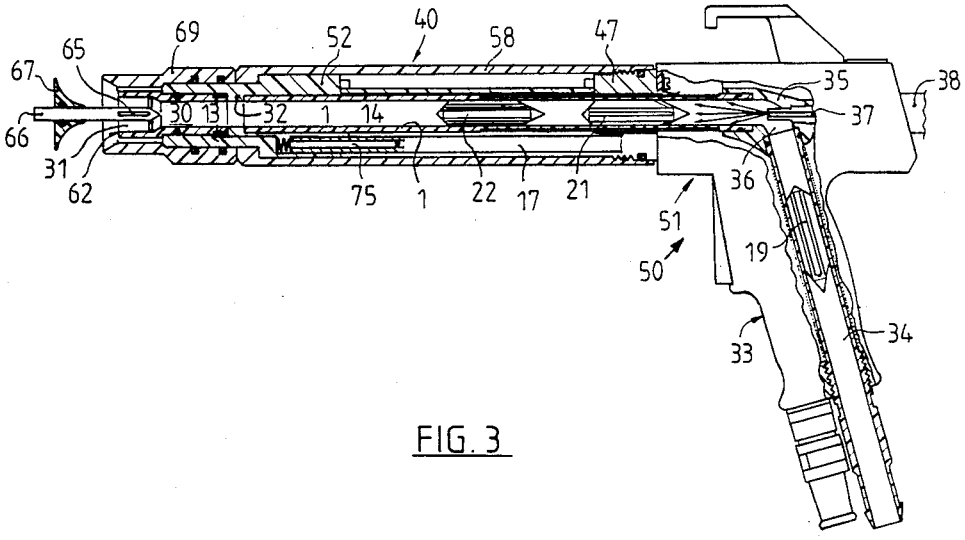

According to FIG. 3, the powder pipe (1) is built into a shaft (40) inside a shaft tube (58) of a spray gun (50), which shaft tube is nonrotatably held between a head piece (52) and a stock piece (47) at the frontal part of the gun housing (51), as known from German published specification No. 25 59 472.

In the frontal part of the head piece (52) a pipe-shaped nozzle (62) is held inside thereof by means of a nozzle sleeve, wherein the flow channel (14) is widened to an annular nozzle opening (31) by a rear cylinder segment (30). Thereby, an internal collar (32) of the head piece (52) fits flush between the powder pipe and the spray nozzle and into the walling of the flow channel (14). A nozzle rod (66) is supported in the frontal end of the nozzle (62) by axially extending radial webs (65) this rod being length-adjustable and carrying a deflecting body (67).

The aftercharging electrodes (13) are here located at the rear end of the nozzle (62), at a distance from the nozzle opening (31). They are connected in the manner previously mentioned in German published specification No. 25 59 472 via a high-resistivity protection resistance (75) to the high-voltage supply (17), which is the form of a high-voltage cable is lead outside at the lower end of the gun handle (33).

Parallel to the path of this high-voltage cable, in the gun handle (33) a delivery channel (34) is provided, which is connected to an elbow-like shaped body (35), as is the powder pipe (1) itself. An injection nozzle (37) abuts the rear extension of the powder pipe (1) in the redirecting area (36), which nozzle is supplied with compressed air through a hose (38).

Thereby, in the redirecting area (36) a negative pressure is created, through which the powder is then ascendingly aspired in the delivery channel (34) and is then again mixed with the carrying air in the pressure jet of the nozzle (37).

The walling of the delivery channel (37) consists as a rule of the same insulating material as the parts (1, 21 and 22) so that the electrostatic charging of the powder starts already at this point. Therefore, a displacement body (19) is there also provided, which basically has the same effect as the displacement bodies (21 and 22).

Figure 4:
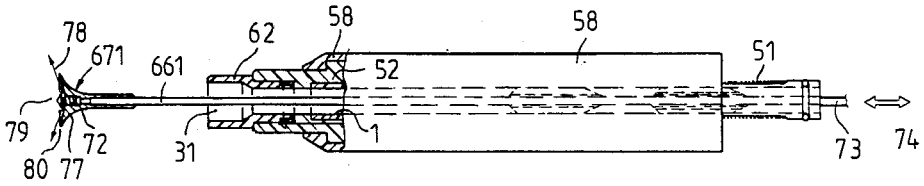

As a modification of the afore-described embodiment, in FIG. 4 a deflecting body (671) rests with its central bore (72) on the frontal end of a pipe-shaped nozzle rod (661), which rearwardly exits the gun housing (51) and is connected to a compressed-gas supply duct (73). This nozzle rod can be displaced in the direction of the double arrow (74) and this way the distance between the deflecting body (671) and the nozzle opening (31) can be modified. While the largely axially expelled powder particles hit the frontal side (77) of the deflecting body and are deflected radially inclined towards the outside, the compressed air from the bore (72) at the rear side (78) of the deflecting body is also radially deflected due to a nozzle arrangement (79) and entrains at the annular edge (80) the flow hitting the frontal side (77), in order to avoid the attachment of powder particles to the back side of the deflecting body.

Figure 5:
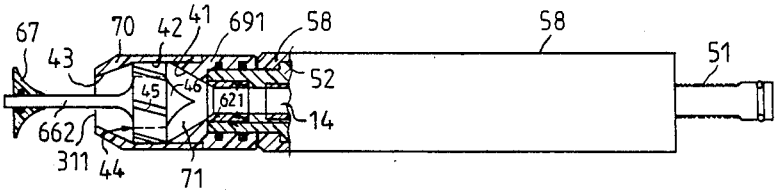

According to FIG. 5, the nozzle bushing (621) is a smooth cylinder and shorter in comparison with the previously described embodiment. It is held in the head piece (52) by a nozzle sleeve (691) encroaching this head piece, on which in turn a nozzle cap (70) is fitted.

The inner space (71) created between the previously mentioned parts widens from the flow channel (14) over a first frustoconical surface (41) molded to the frontal surfaces of the nozzle bushing (621) and the nozzle sleeve into a cylindrical middle space (42) and narrows up to the annular nozzle opening (311) along a frustoconical surface (43). In the cylindrical middle space (42) of the inner space (71) a guide body (44) is nonrotatably located, which carries the nozzle rod (662) with the deflecting body (67).

Guide body (44) is provided at its circumferential side with a screw-like arrangement, i.e. shaped guiding elements (45), which can be shaped as grooves and ribs, so that in any case threaded arrow channels result, through which the powder flow is directed to pass, whereby the powder is additionally brought into contact with the guide body (44) and the walling of the nozzle cap (70). The guide body as well as the nozzle cap (70) are suitably made of triboelectric material, such as PTFE, in order to create a further charging opportunity. A shaped guiding insertion (46) frontally mounted on the guide body (44) serves as the entrance into the threaded channels (45).

While in the case of the embodiments of FIGS. 1 to 4, the charging occurs first only through frictional contacts and then the powder potential is increased by an externally mounted aftercharging device (12), here a third charging process is provided, due to the triboelectric aftercharging. This way, the charging state achieved through external charging can hardly be essentially increased. However, it is insured that the charging state is maintained up to the exit through the nozzle opening (311) during the vorticity-creating process of the exiting flow. The coating powder this way directed to the workpiece without an externally created electrostatic field through electrostatic forces can considerably easier penetrate in the neutral zones of the workpiece thereby improving coating efficiency. In addition to the electric advantages, the guide body (44) transforms the high linear velocity of the flow into a rotating powder discharge. Through this process, an improved powder distribution is achieved at a reduced discharge velocity which additionally increases the degree of coating efficiency.

If the materials in the electrostatic series are arranged oppositely with respect to the above example, e.g. the charged particles at the powder pipe are positive and the powder particles are negative, a negative voltage has also to be provided at the aftercharge electrode (13).

We claim:

1. Electrostatic device for spraying powder particles with triboelectric charging by means of a powder pipe surrounding a delivery channel which constitutes part of a flow channel for the spray powder and of at least one displacement body mounted in the flow channel in order to increase the flow velocity, whereby the powder pipe is grounded on its outside and provided at least on its inside with a triboelectric material which is arranged at a distance from the powder particles to be sprayed, the improvement comprising an aftercharging device for the triboelectrically charged powder particles having the same polarity as that polarity induced during the electrostatic charging, and the aftercharging device also has aftercharger electrodes arranged inside the powder pipe.

2. Device according to claim 1, wherein the triboelectric material is formed by an insulating synthetic material.

3. Device according to claim 1, wherein the displacement body is provided at least externally with the same triboelectric material the powder pipe is provided with internally.

4. Device according to claim 3, wherein the powder pipe and the displacement body is each predominantly made in one piece of triboelectric material.

5. Device according to claim 1, further comprising a feeding device for accelerating air having the purpose to further increase flow velocity.

6. Device according to claim 1, wherein an earth connection of the powder pipe has an earthed conductive body mounted on an outside surface of said pipe and which is made of a material with good electrical conductivity.

7. Device according to claim 1, wherein the aftercharger electrodes comprise wire electrodes extending from the walling of the powder pipe radially inward.

8. Device according to claim 1, wherein the aftercharger electrodes are mounted at a distance from the outlet end of the powder pipe.

9. Device according to claim 1, wherein the aftercharger electrodes are connected to a high-voltage supply via highly resistive protection resistance.

10. Device according to claim 1, wherein said at least one displacement body has several guide ribs arranged axially in the powder pipe and inclined towards each other.

11. Device according to claim 10, wherein several of said displacement bodies are fixedly arranged one after another in a powder flow direction in staggered rotation from one another about a flow axis of the powder pipe.

12. Device according to claim 10, wherein said at least one displacement body is tapered at least at one of its ends, whereby the guide ribs extend in a wedge-like manner.

13. Device according to claim 1, wherein said at least one displacement body is mounted nonrotatably on the inner surface of the powder pipe.

14. Device according to claim 6, further comprising a metallic connection, serving especially for securing against rotation, between said earthed conductive body of the powder pipe and a metallic connection part of said displacement body.

15. Device according to claim 1, having a deflection body arranged before the outlet end of the powder pipe and located on a rod passing through the powder pipe, wherein the rod is a hollow rod and has an air feeder for the aeration of the deflection body.

16. Device according to claim 1, wherein the powder pipe is widened between the aftercharger electrodes and an outlet end of said pipe.

17. Device according to claim 16, wherein in widening of the flow channel a guide body is inserted with guide surfaces oriented in a circumferential direction.

18. Device according to claim 17, wherein the outlet end of the powder pipe outside the widening is again narrowed.

19. Device according to claim 18, wherein the guide body is made of tetrafluoro ethylene.

20. Device according to claim 19, wherein the guide body is shaped to receive the deflecting body.

21. Device according to claim 19, wherein the guide body is equipped for the frontal aeration of the deflecting body.

22. Device according to claim 2, characterized in that the insulating synthetic material is polytetrafluoroethylene.

23. Electrostatic device for spraying powder particles with triboelectric charging by means of a powder pipe surrounding a delivery channel which constitutes part of a flow channel for the spray powder and a plurality of displacement bodies mounted in the flow channel in order to increase the flow velocity, whereby the powder pipe is grounded on its outside and provided at least on its inside with a triboelectric material which is arranged at a distance from the powder particles to be sprayed, characterized by an aftercharging device for the triboelectrically charged powder particles having the same polarity as that polarity induced during the electrostatic charging, and wherein several of said displacement bodies being fixedly arranged one after another in a powder flow direction each have a plurality of axial guide ribs which lie in staggered rotation from one another about a flow axis of the powder pipe and so that none of the guide ribs are in axial alignment with another guide rib.

24. The device according to claim 23, wherein one of said displacement bodies has its guide rib fixedly rotated relative to the guide rib of a second of said displacement bodies by an angle of about 45°.

* * * * *